US012655712B2

(12) United States Patent
Shi et al.

(10) Patent No.: US 12,655,712 B2
(45) Date of Patent: Jun. 16, 2026

(54) DATA ACQUISITION SYSTEM AND METHOD APPLIED TO PETROLEUM EXPLORATION ENGINEERING

(71) Applicant: Zhejiang Tensing Science and Technology Co., Ltd., Ningbo (CN)

(72) Inventors: Zhaorui Shi, Ningbo (CN); Liangzhu Yan, Ningbo (CN); Shan Chen, Ningbo (CN); Jinxiao Wang, Ningbo (CN)

(73) Assignee: Zhejiang Tensing Science and Technology Co., Ltd., Ningbo (CN)

( * ) Notice: Subject to any disclaimer, the term of this patent is extended or adjusted under 35 U.S.C. 154(b) by 0 days.

(21) Appl. No.: 19/195,606

(22) Filed: Apr. 30, 2025

(65) Prior Publication Data

US 2025/0257629 A1 Aug. 14, 2025

(30) Foreign Application Priority Data

Nov. 15, 2024 (CN) ..... 202411636036.9

(51) Int. Cl.
*E21B 33/12* (2006.01)
*E21B 47/07* (2012.01)
*E21B 47/12* (2012.01)

(52) U.S. Cl.
CPC ..... *E21B 33/1208* (2013.01); *E21B 47/07* (2020.05); *E21B 47/12* (2013.01); *E21B 2200/08* (2020.05)

(58) Field of Classification Search
CPC ..... E21B 47/26; E21B 33/1208; E21B 47/12
See application file for complete search history.

(56) References Cited

U.S. PATENT DOCUMENTS

| | | | | |
|---|---|---|---|---|
| 7,543,635 | B2 * | 6/2009 | East | E21B 47/01 166/250.1 |
| 7,597,143 | B2 * | 10/2009 | Giacomino | E21B 47/017 166/250.11 |
| 7,690,425 | B2 * | 4/2010 | Giacomino | E21B 43/121 166/250.11 |
| 8,800,652 | B2 * | 8/2014 | Bartko | E21B 43/26 166/308.1 |
| 10,801,315 | B2 * | 10/2020 | Fripp | E21B 43/26 |
| 10,914,163 | B2 * | 2/2021 | Bustos | E21B 47/138 |
| 11,377,950 | B2 * | 7/2022 | Fripp | E21B 47/092 |
| 11,566,479 | B1 * | 1/2023 | Ogundare | E21B 19/22 |
| 11,859,449 | B2 * | 1/2024 | Li | E21B 47/138 |
| 12,258,830 | B1 * | 3/2025 | Muhammad | E21B 47/138 |
| 12,281,540 | B2 * | 4/2025 | Bin Ziad | G01L 19/086 |
| 12,378,856 | B1 * | 8/2025 | Bridges | E21B 43/128 |
| 2002/0020525 | A1 * | 2/2002 | Willauer | E21B 47/06 166/135 |
| 2003/0205410 | A1 * | 11/2003 | Koch | E21B 44/00 175/45 |
| 2005/0178543 | A1 * | 8/2005 | Giacomino | E21B 47/01 166/250.01 |

(Continued)

*Primary Examiner* — Steven A Macdonald

(57) ABSTRACT

A data acquisition system and method applied to petroleum exploration engineering comprises a bridge plug and at least one data logger, where the bridge plug is made of a soluble material, the bridge plug with the data logger is placed in a petroleum exploration channel and gradually displaced to an area with cracks, so that the data logger can monitor temperature and pressure in real time, and then the data logger is retrieved to read and analyze data.

12 Claims, 10 Drawing Sheets

(56) References Cited

U.S. PATENT DOCUMENTS

| | | | | |
|---|---|---|---|---|
| 2008/0110617 | A1* | 5/2008 | Giacomino | E21B 47/01 166/162 |
| 2011/0120702 | A1* | 5/2011 | Craig | E21B 43/26 703/2 |
| 2011/0132621 | A1* | 6/2011 | Agrawal | E21B 33/1208 228/101 |
| 2012/0193090 | A1* | 8/2012 | Lopez De Cardenas | E21B 47/00 166/250.01 |
| 2013/0299241 | A1 | 11/2013 | Alberty et al. | |
| 2013/0333890 | A1* | 12/2013 | Dagenais | E21B 29/02 166/302 |
| 2014/0110123 | A1* | 4/2014 | Murphree | E21B 33/1204 419/38 |
| 2015/0129239 | A1* | 5/2015 | Richard | E21B 33/128 166/195 |
| 2017/0051578 | A1* | 2/2017 | Christie | G05B 15/02 |
| 2017/0328196 | A1* | 11/2017 | Shi | E21B 47/138 |
| 2017/0328197 | A1* | 11/2017 | Shi | E21B 47/138 |
| 2017/0350241 | A1* | 12/2017 | Shi | E21B 21/08 |
| 2018/0245448 | A1* | 8/2018 | Fripp | E21B 47/06 |
| 2019/0316459 | A1* | 10/2019 | Chen | E21B 43/26 |
| 2019/0338613 | A1* | 11/2019 | Kibler | E21B 47/06 |
| 2020/0033899 | A1* | 1/2020 | Van Haaren | E03B 11/08 |
| 2020/0131899 | A1* | 4/2020 | Chen | E21B 47/10 |
| 2020/0225384 | A1 | 7/2020 | Zhu et al. | |
| 2021/0238982 | A1* | 8/2021 | Schulte | E21B 33/12 |
| 2023/0083651 | A1 | 3/2023 | Tian et al. | |
| 2023/0175332 | A1* | 6/2023 | Al-Obaidi | E21B 23/001 166/250.01 |
| 2023/0399939 | A1* | 12/2023 | Evans | E21B 47/06 |
| 2024/0200443 | A1* | 6/2024 | van Zelm | E21B 47/16 |
| 2024/0401436 | A1* | 12/2024 | Bin Ziad | G01L 19/0092 |

* cited by examiner

DATA ACQUISITION SYSTEM AND METHOD APPLIED TO PETROLEUM EXPLORATION ENGINEERING

TECHNICAL FIELD

The present invention relates to the technical field of equipment used in petroleum exploration engineering, in particular to a data acquisition system and method applied to petroleum exploration engineering.

BACKGROUND

At present, for petroleum exploration projects, petroleum exploration channels are generally drilled underground, and then bridge plugs are placed in the petroleum exploration channels in sections. During the placement process, cracks are impacted on an inner wall of a side area at one end portion of the bridge plug facing a channel mouth using the perforating projectile technology, then a fracturing fluid is injected, and finally one port of the bridge plug facing the channel mouth is plugged by a bridge plug ball, and so on. This process is repeated, so that there are fracturing fluid and cracks between two adjacent bridge plugs, and finally the channel mouth of the petroleum exploration channel is closed for a period of time, so that the fracturing fluid gradually expands and extends the cracks, and then the channel mouth of the petroleum exploration channel is manually checked for oil seepage. However, the bridge plug in the prior art lacks real-time monitoring and data acquisition functions, and cannot effectively evaluate plugging effect of the bridge plug and downhole environment state.

SUMMARY

The present invention provides a data acquisition system and method applied to petroleum exploration engineering to solve the above technical problems.

The present invention provides a data acquisition system applied to petroleum exploration engineering, including: a bridge plug made of a soluble material and configured to be placed in a petroleum exploration channel; and at least one data logger mounted on the bridge plug, where the at least one data logger is located in an area with cracks in the petroleum exploration channel after the bridge plug is expanded and snapped in the petroleum exploration channel.

The at least one data loggers includes a housing, and a pressure transducer, a temperature transducer, a data memory and a controller placed in a closed space of the housing; the pressure transducer and the temperature transducer monitor temperature and pressure in the area with cracks in the petroleum exploration channel in real time, and transmit monitored temperature signal and pressure signal to the controller; and the controller converts the temperature signal and the pressure signal into temperature data and pressure data respectively, and transmits the temperature data and the pressure data to the data memory for storage and retention.

In another aspect, a data acquisition method applied to petroleum exploration engineering includes: mounting at least one data logger on a bridge plug made of a soluble material; placing the bridge plug with the at least one data logger into a petroleum exploration channel and gradually displacing the bridge plug to a specified position; allowing the bridge plug to reach the specified position and be expanded and snapped in the petroleum exploration channel, so that the at least one data logger on the bridge plug is located in an area with cracks and a fracturing fluid in the petroleum exploration channel; allowing the at least one data logger on the bridge plug to enter an operating state to monitor temperature and pressure in the area with cracks in the petroleum exploration channel in real time by the pressure transducer and the temperature transducer of the data logger, and transmit monitored temperature signal and pressure signal to the controller of the data logger; allowing the controller of the data logger to convert the temperature signal and the pressure signal into temperature data and pressure data respectively, and transmit the temperature data and pressure data to the data memory of the data logger for storage and retention; after the bridge plug is dissolved in the fracturing fluid, allowing the at least one data logger to float to a mouth portion of the petroleum exploration channel under the buoyancy of the fracturing fluid; and retrieving the data logger, and then communicatively connecting an upper computer with the data logger to read the data stored in the data memory of the data logger, and analyzing the read data by the upper computer.

The present invention provides a data acquisition system and method applied to petroleum exploration engineering, which utilizes a data logger provided on a bridge plug to monitor temperature and pressure changes during an oil well plugging process in real time, so that when the bridge plug is dissolved, the data logger can be floated to a channel mouth using a fracturing fluid, and then the data logger is retrieved to read and analyze data to know temperature and pressure of an area with cracks, so that exploration workers can more intuitively observe oil seepage in each area with cracks.

Figure 1:
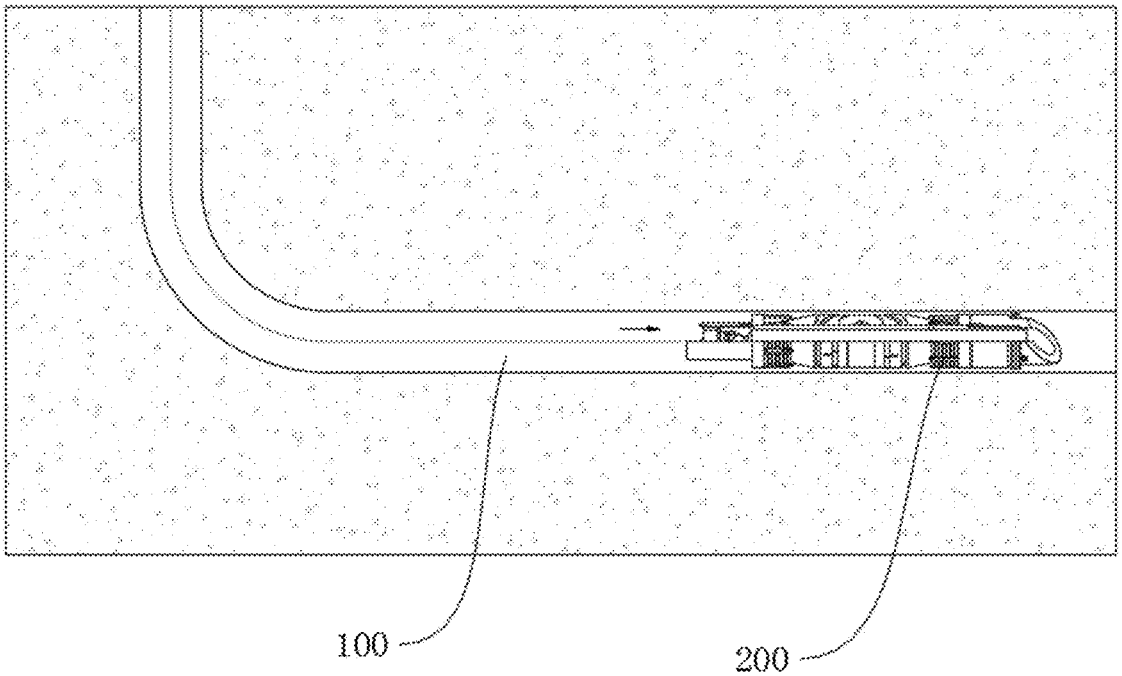
FIG. 1 is a schematic diagram of putting a bridge plug into a petroleum exploration channel.
Figure 2:
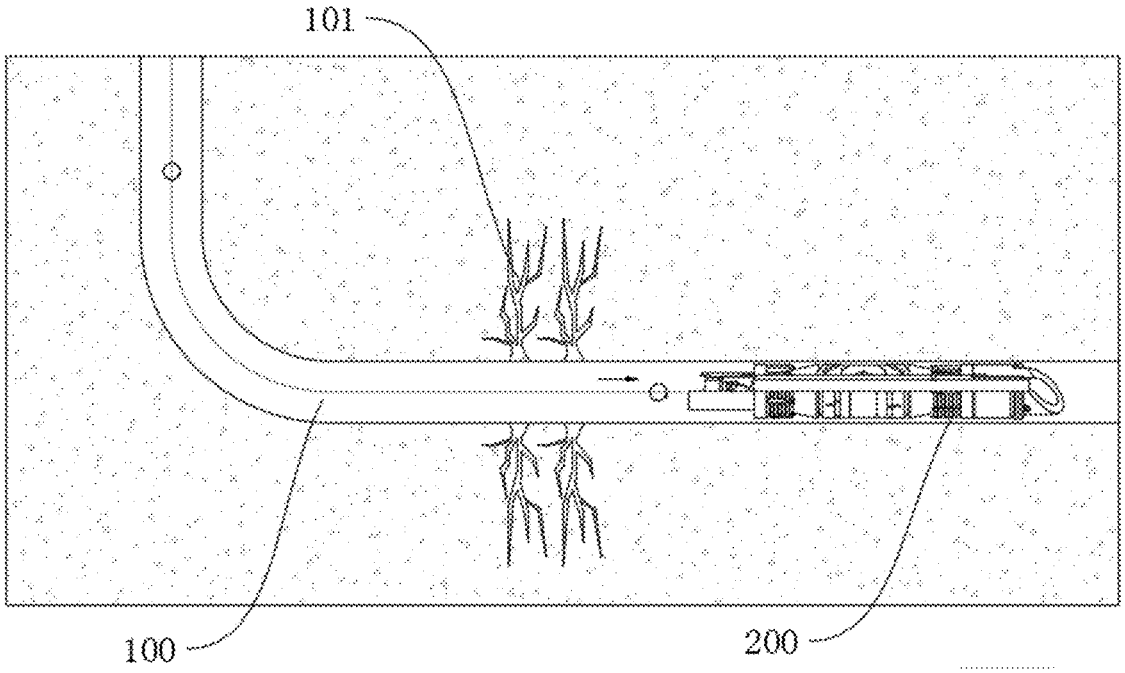
FIG. 2 is a schematic diagram of putting a bridge plug ball into a petroleum exploration channel and plugging a channel port in the bridge plug.
Figure 3:
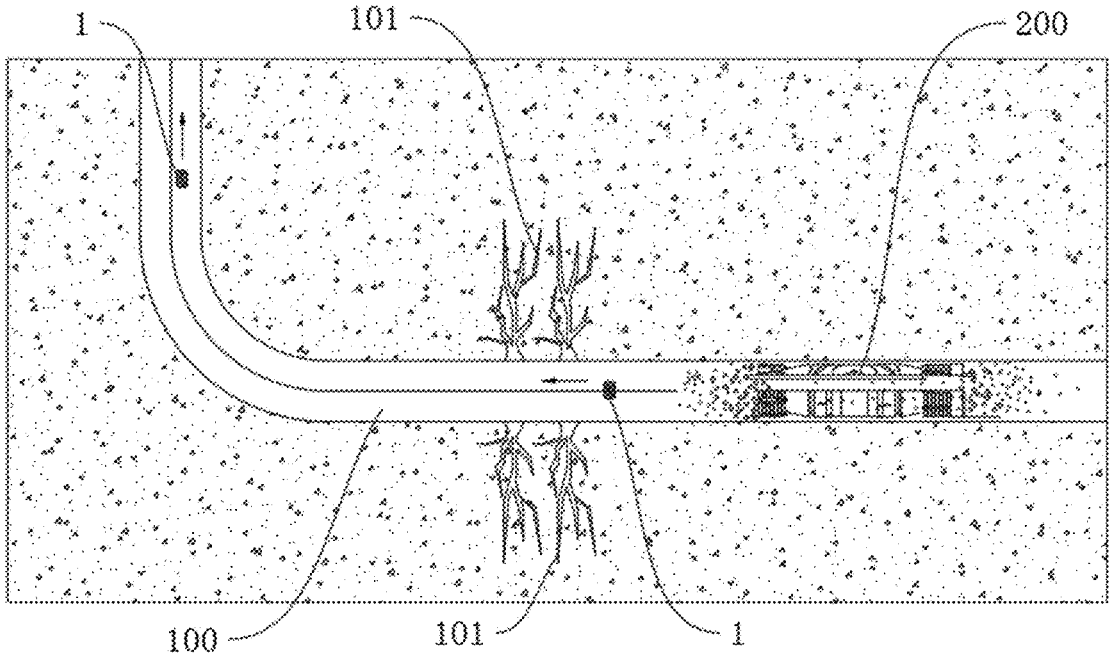
FIG. 3 is a schematic diagram of a bridge plug after dissolution.

Reference numerals in the drawings: 1. data logger; 10. housing; 11. circuit board; 12. pressure transducer; 13. rechargeable battery; 14. wireless charging coil; 15. temperature transducer; 16. transmitting module; 17. infrared receiving module; 18. indicator light; 19. controller; 3. soluble mounting body; 30. through hole; 31. first shell; 311. annular recess; 32. second shell; 321. annular protrusion; 33. connecting column; 4. soluble sleeve body; 40. mounting hole; 41. first hoop body; 42. second hoop body; 43. convex strip; 44. first connecting block; 45. second connecting block; 46. elastic connecting wire; 47. fixing hole; 100. petroleum exploration channel; 101. crack; 200. bridge plug; 201. soluble bridge plug body; 202. dimple; and 20. data memory.

DESCRIPTION OF THE EMBODIMENTS

The technical solutions in the embodiments of the present invention will be clearly and completely described below in conjunction with the accompanying drawings in the embodiments of the present invention. Obviously, the embodiments described are only part but not all of the embodiments of the present invention. All other embodiments obtained by those of ordinary skill in the art based on the embodiments of the present invention fall within the scope of the present invention.

Embodiment 1

As shown in FIGS. 1 to 16, a data acquisition system applied to petroleum exploration engineering described in the present embodiment includes a bridge plug 200 and at least one data logger 1, the bridge plug 200 is made of a soluble material and configured to be placed in a petroleum exploration channel 100, and the at least one data logger 1 is located in an area with cracks 101 in the petroleum exploration channel 100 after the bridge plug 200 is expanded and snapped in the petroleum exploration channel 100; where one or more data loggers 1 may be employed, preferably eight data loggers.

Figure 4:
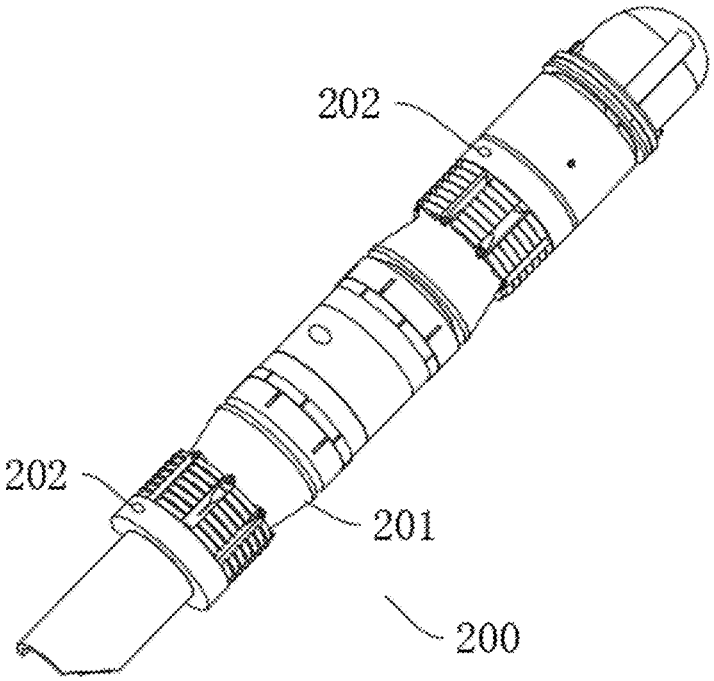
FIG. 4 is a schematic structural diagram of a bridge plug with a dimple.

In one embodiment, the bridge plug 200 includes a soluble bridge plug body 201 and at least one dimple 202 provided on the soluble bridge plug body 201, the at least one data logger 1 is mounted in the at least one dimple 202, and a housing 10 of the at least one data logger 1 is arranged in tight fit with an inner wall of the at least one dimple 202, as shown in FIG. 4.

Figure 5:
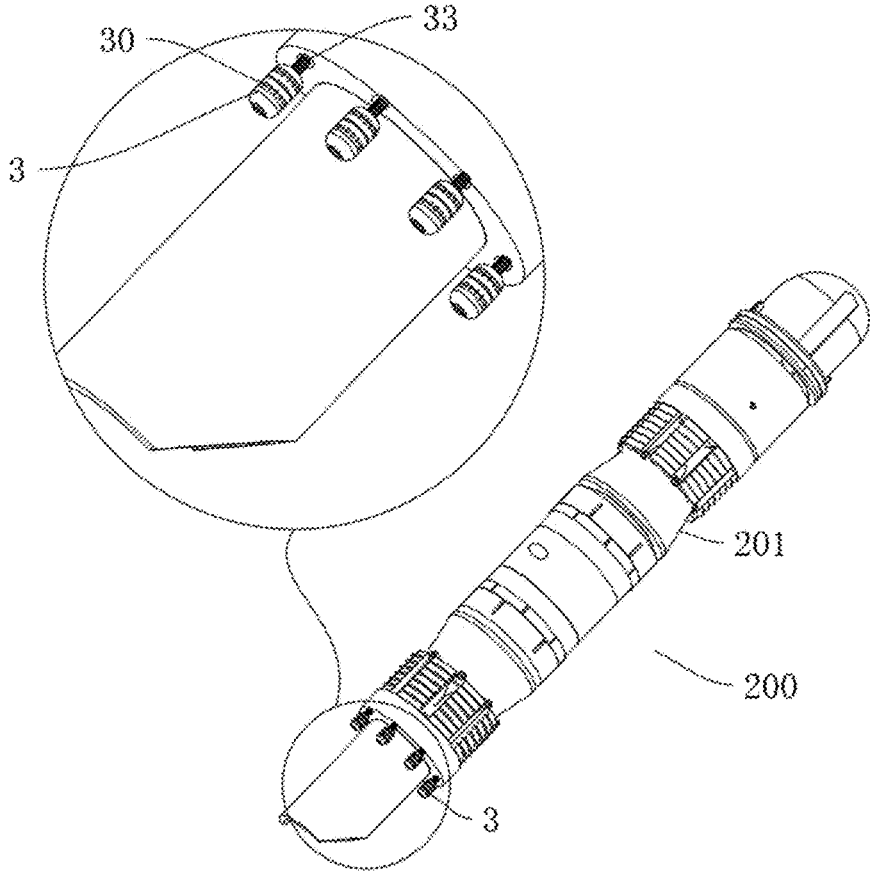
FIG. 5 is a schematic structural diagram of a soluble mounting body mounted on a bridge plug by a connecting column.
Figure 6:
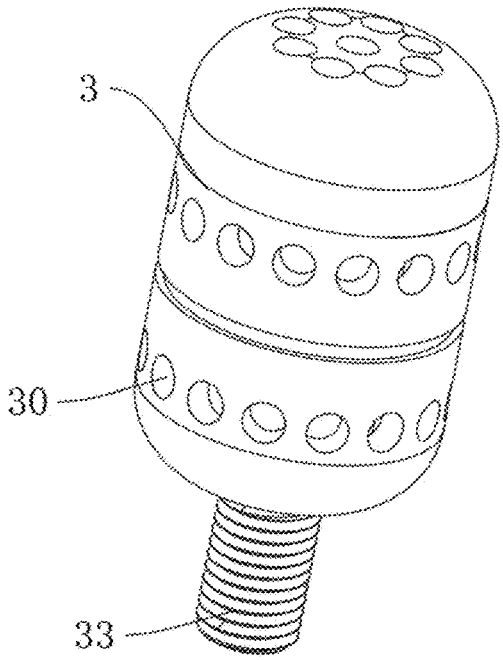
FIG. 6 is a first schematic structural diagram of a data logger mounted in a soluble mounting body.

In another embodiment, the bridge plug 200 includes a soluble bridge plug body 201 and at least one soluble mounting body 3, a mounting space and a through hole 30 communicating the mounting space with the outside are provided in the soluble mounting body 3, the data logger 1 is placed in the mounting space, and the soluble mounting body 3 is mounted on the soluble bridge plug body 201 via a connecting structure before being placed into the petroleum exploration channel 100, as shown in FIGS. 5 and 6.

Figure 7:
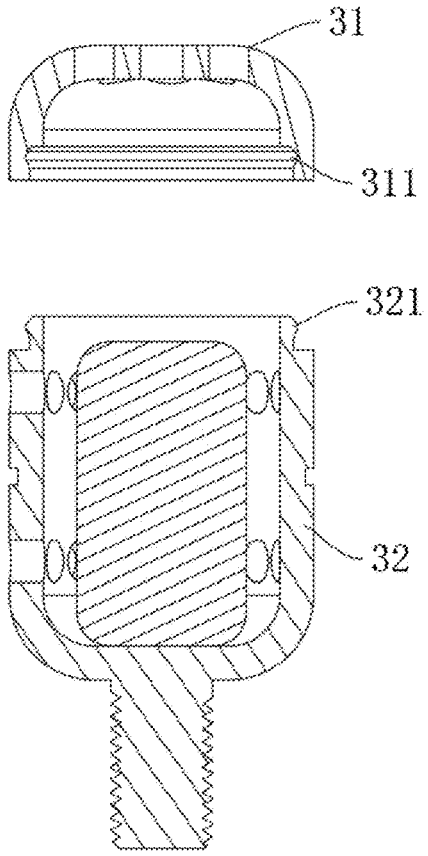
FIG. 7 is a second schematic structural diagram of the data logger mounted in the soluble mounting body.

Further, the soluble mounting body 3 includes a first shell 31 and a second shell 32, the first shell 31 and the second shell 32 are spliced and fixed together to form a mounting space therebetween, a through hole 30 is provided on at least one of the first shell 31 and the second shell 32, the through hole 30 is in an exposed state, and the first shell 31 and the second shell 32 are both made of a soluble material; since an annular recess 311 is formed on an inner wall of a port of the first shell 31, and an annular protrusion 321 is formed on an outer wall of a port of the second shell 32, or an annular recess 311 is formed on an inner wall of a port of the second shell 32, and an annular protrusion 321 is formed on an outer wall of a port of the first shell 31, where the annular protrusion 321 and the annular recess 311 are formed in a radial direction, the annular protrusion 321 is embedded into the annular recess 311 after being spliced together, so that the first shell 31 and the second shell 32 are fixedly connected to each other, as shown in FIG. 7.

Figure 8:
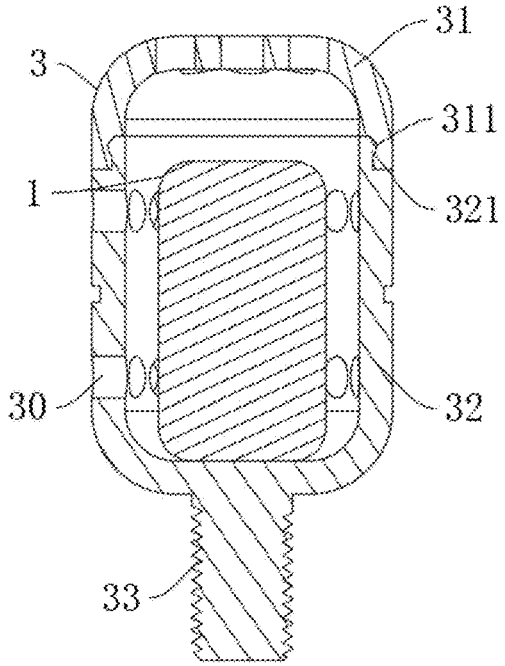
FIG. 8 is a third schematic structural diagram of the data logger mounted in the soluble mounting body.
Figure 9:
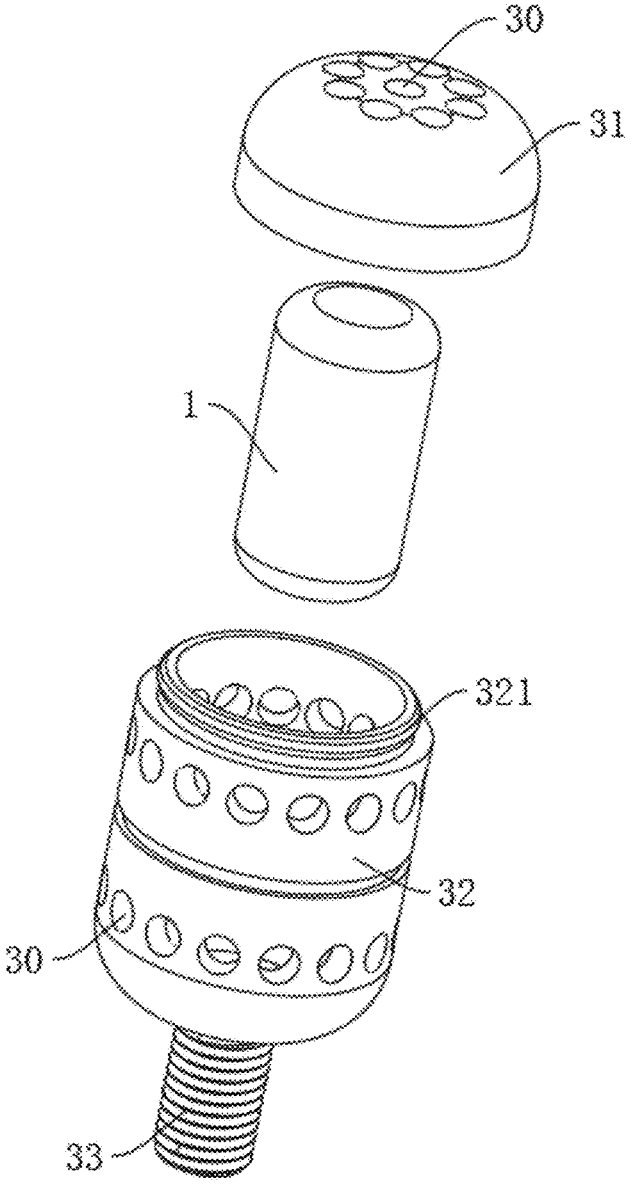
FIG. 9 is a fourth schematic structural diagram of the data logger mounted in the soluble mounting body.

In one way in another embodiment, the connecting structure includes a connecting column 33 provided on the first shell 31 or the second shell 32 and at least one connecting hole provided on the soluble bridge plug body 201, the connecting column 33 on the at least one soluble mounting body 3 is placed in the at least one connecting hole and then threadedly connected or snap-fitted or interference-fitted with each other, and the connecting column 33 is made of a soluble material; or the connecting structure includes a connecting hole provided on the first shell 31 or the second shell 32 and at least one connecting column 33 provided on the soluble bridge plug body 201, the at least one connecting column 33 on the soluble bridge plug body 201 is placed in the at least one connecting hole and then threadedly connected or snap-fitted or interference-fitted with each other, and the connecting column 33 is made of a soluble material; where the connecting hole is arranged at an end portion of the soluble bridge plug body 201, and when the soluble bridge plug body 201 is placed into the petroleum exploration channel 100, the data collector 1 is located at an end position of the soluble bridge plug body 201 facing a channel mouth of the petroleum exploration channel 100, and the connecting column 33 and the connecting hole are preferentially threadedly connected, as shown in FIGS. 8 and 9.

Figure 10:
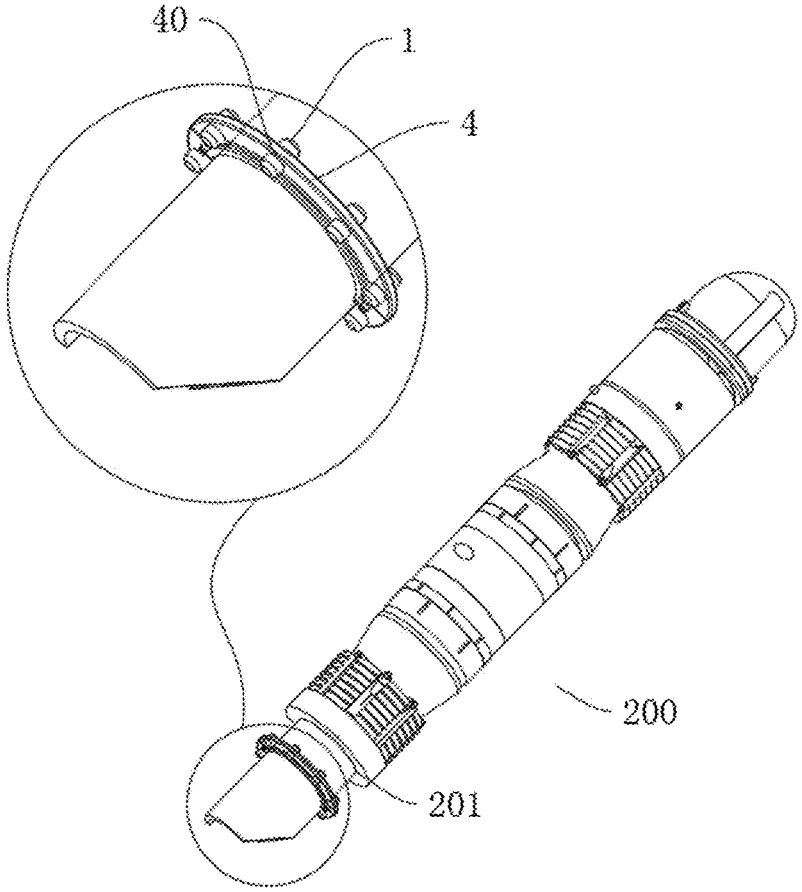
FIG. 10 is a schematic structural diagram of a data logger mounted on a bridge plug using a soluble sleeve body.

In another way in another embodiment, the bridge plug 200 includes a soluble bridge plug body 201 and a soluble sleeve body 4 hooped on the soluble bridge plug body 201, at least one mounting hole 40 is provided on the soluble sleeve body 4, and the housing 10 of the data logger 1 is at least partially placed in the mounting hole 40 and fixed to each other, preferably fixed by interference fit, as shown in FIG. 10.

Figure 11:
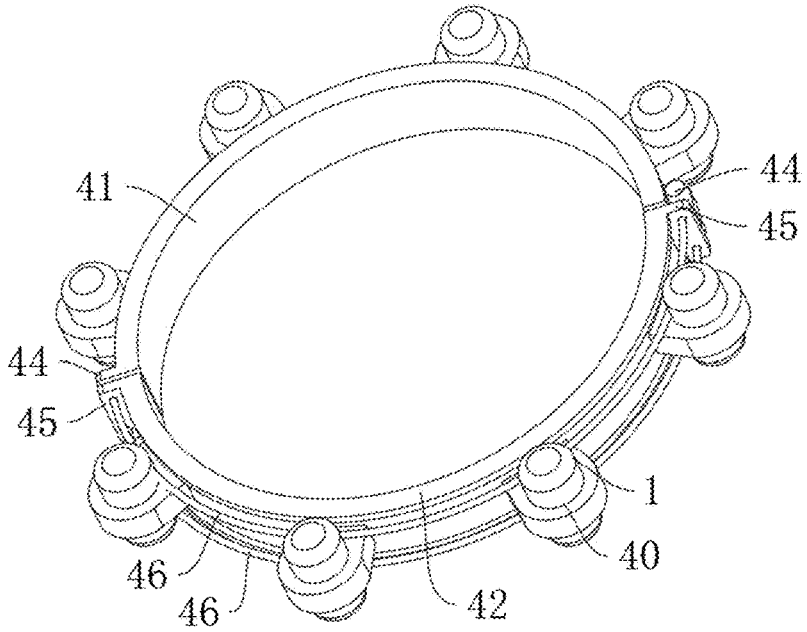
FIG. 11 is a first schematic structural diagram of a data logger mounted on a soluble sleeve body.

Preferably, the soluble sleeve body 4 includes an elastic connecting wire 46, a first hoop body 41 and a second hoop body 42, at least one of the first hoop body 41 and the second hoop body 42 is provided with at least one mounting hole 40, the first hoop body 41 and the second hoop body 42 are both made of a soluble material, the elastic connecting wire 46 is located between an outer wall on the first hoop body 41 and a mounting area on the first hoop body 41 for mounting the data logger 1, or the elastic connecting wire 46 is located between an outer wall on the second hoop body 42 and a mounting area on the second hoop body 42 for mounting the data logger 1; when a half groove of the first hoop body 41 and a half groove of the second hoop body 42 are symmetrical with each other and in fit with an outer wall of the end portion of the soluble bridge plug body 201, one end of the elastic connecting wire 46 is simultaneously connected with one end of the first hoop body 41 and one end of the second hoop body 42, and the other end of the elastic connecting wire 46 is simultaneously connected with the other end of the first hoop body 41 and the other end of the second hoop body 42, so that an inner wall on the half groove of the first hoop body 41 and an inner wall on the half groove of the second hoop body 42 are tightly adhered to an outer wall of the soluble bridge plug body 201, so that the soluble sleeve body 4 is sleeved and fixed to the outer wall of the soluble bridge plug body 201; where both ends of the first hoop body 41 are provided with a first connecting block 44, and both ends of the second hoop body 42 are also provided with a second connecting block 45, fixing holes 47 on the first connecting blocks 44 are arranged in correspondence to fixing holes 47 on the two second connecting blocks 45 respectively, one end of the elastic connecting wire 46 is simultaneously inserted into the fixing hole 47 on one of the first connecting blocks 44 and the fixing hole 47 on one of the second connecting blocks 45, and the other end of the elastic connecting wire 46 is simultaneously inserted into the fixing hole 47 on the other of the first connecting blocks 44 and the fixing hole 47 on the other of the second connecting blocks 45, and each of the fixing holes 47 is respectively fixed with both end portions of the elastic connecting wire 46 by interference fit; and the elastic connecting wire 46 is made of a metal material, generally a steel wire, as shown in FIG. 11.

Figure 12:
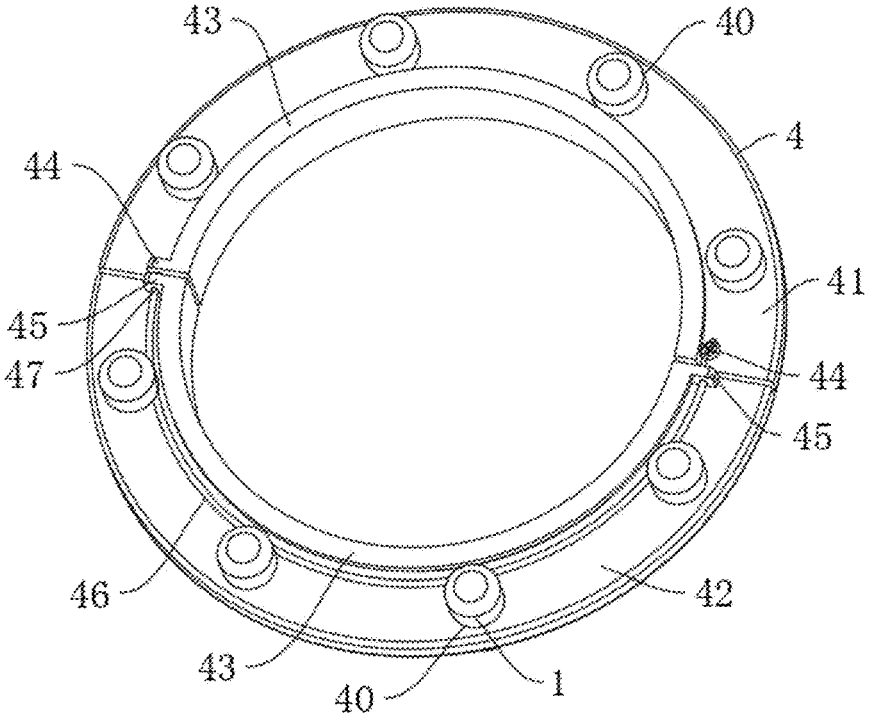
FIG. 12 is a second schematic structural diagram of the data logger mounted on the soluble sleeve body.
Figure 13:
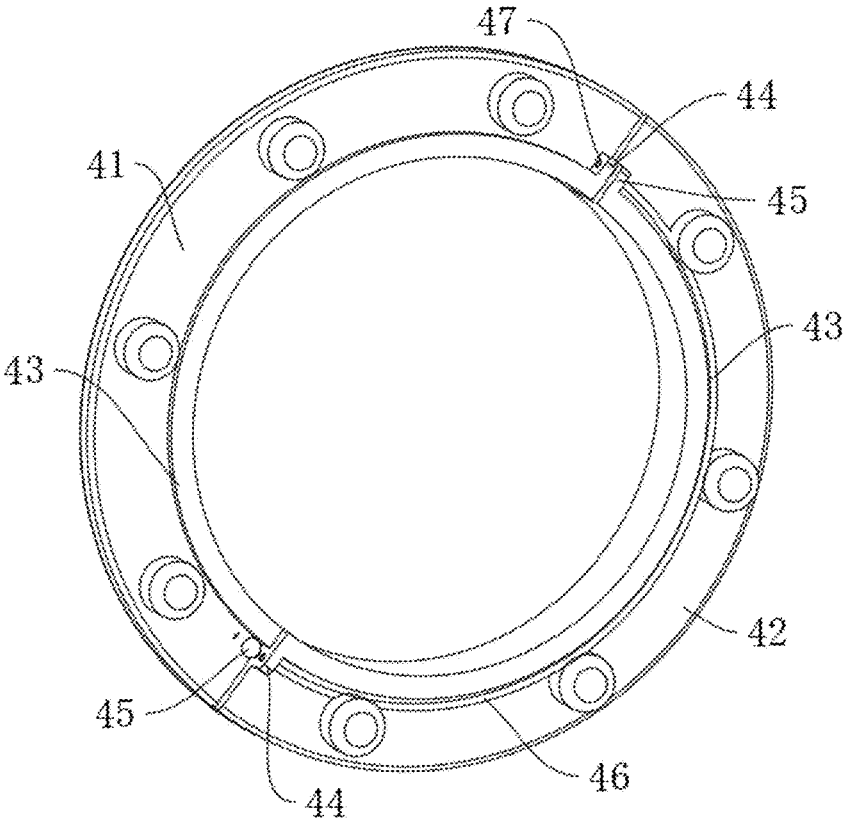
FIG. 13 is a third schematic structural diagram of the data logger mounted on the soluble sleeve body.
Figure 14:
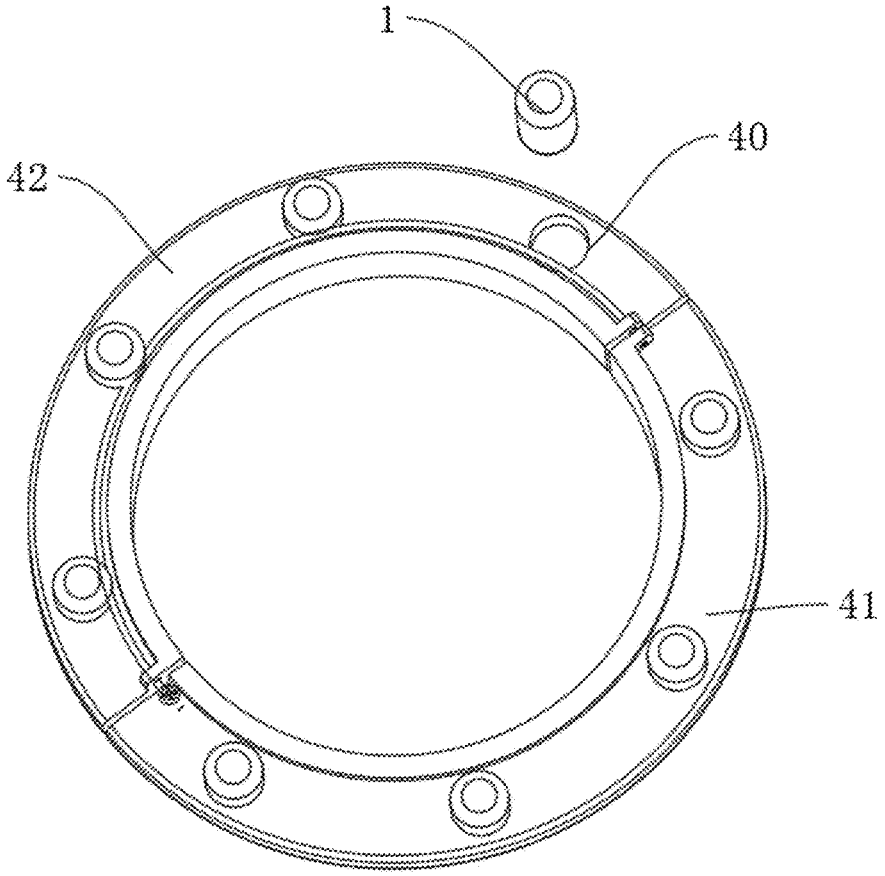
FIG. 14 is a fourth schematic structural diagram of the data logger mounted on the soluble sleeve body.

In another embodiment, a convex strip 43 is provided on the first hoop body 41 or the second hoop body 42, and the convex strip 43 arranged continuously or at intervals is formed on upper and lower edges of the half groove of the first hoop body 41 or the second hoop body 42, the elastic connecting wire 46 is located between an outer wall of the convex strip 43 and a mounting area on the first hoop body 41 or the second hoop body 42 for mounting the data logger 1, both ends of the first hoop body 41 located on the convex strip 43 are respectively connected with the two first connecting blocks 44, and both ends of the second hoop body 42 located on the convex strip 43 are respectively connected with the two second connecting blocks 45, as shown in FIGS. 12 to 14.

Figure 15:
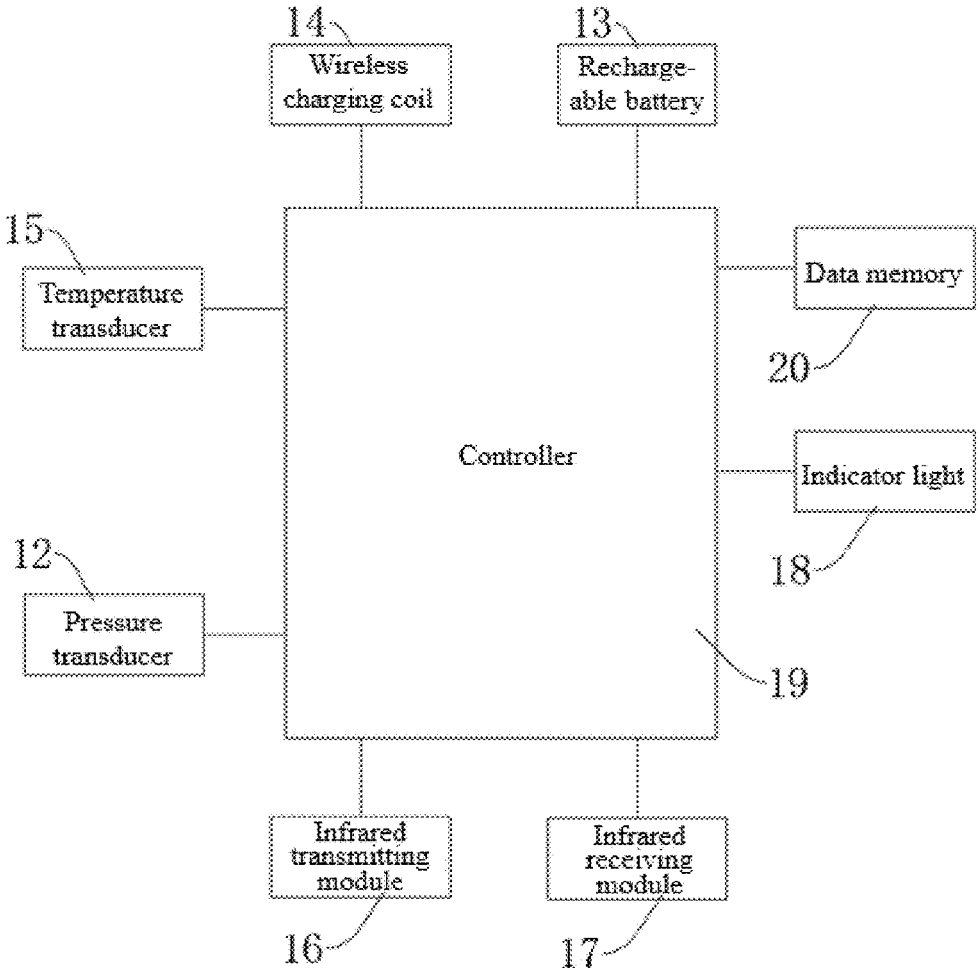
FIG. 15 is a first schematic structural diagram of a data logger.
Figure 16:
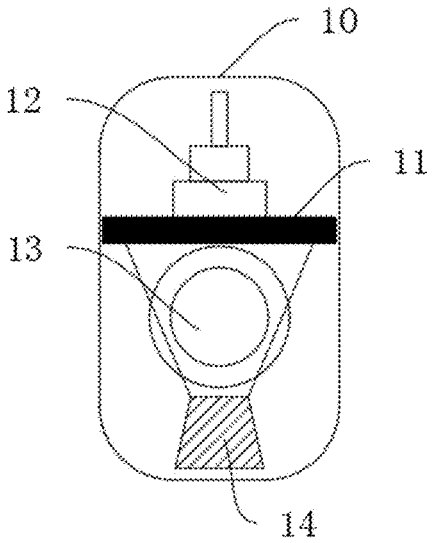
FIG. 16 is a second schematic structural diagram of the data logger.
Figure 17:
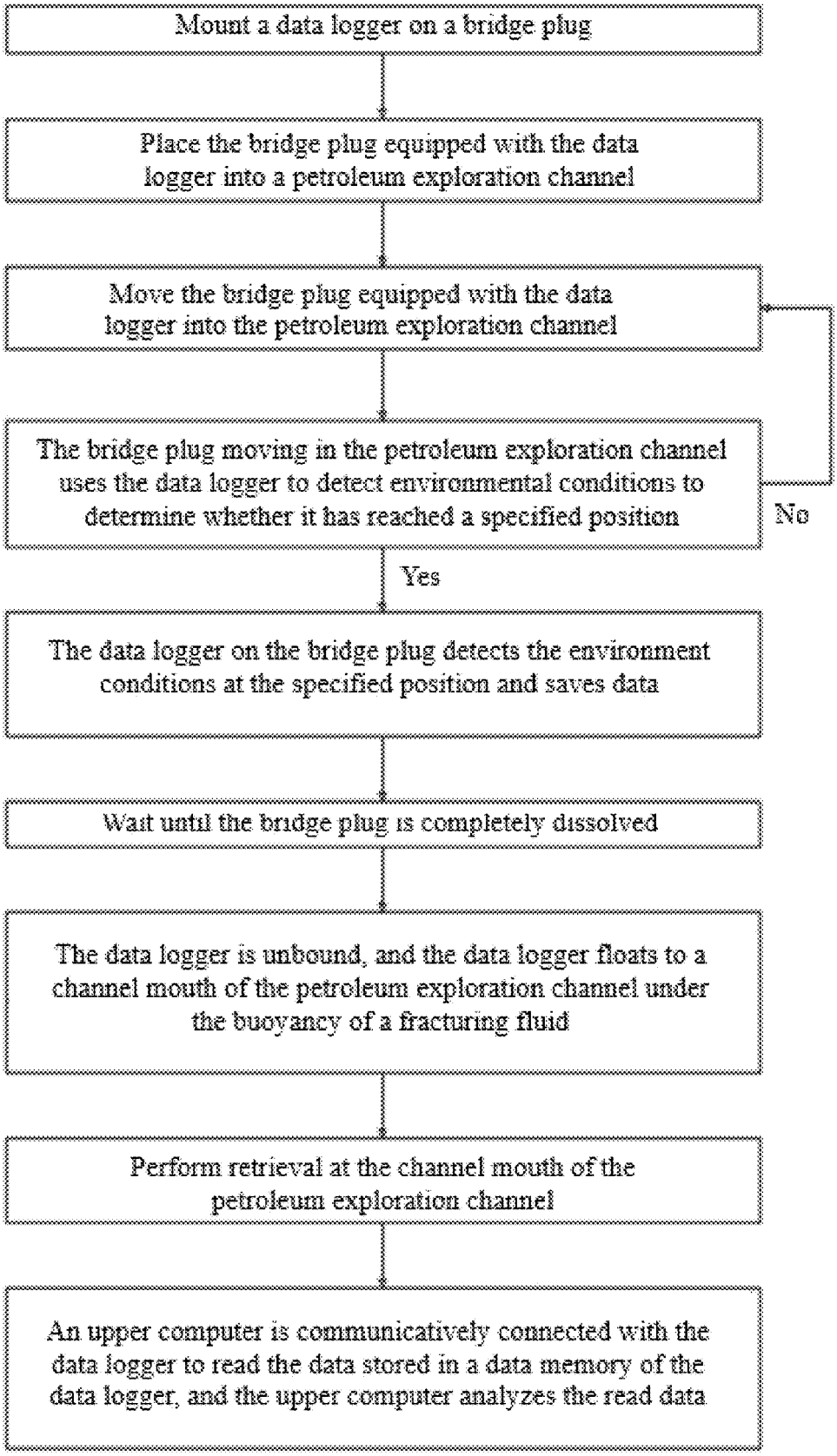
FIG. 17 is a flow block diagram of Embodiment 2 of the present invention.

As shown in FIGS. 15 and 16, the data logger 1 includes a pressure transducer 12, a temperature transducer 15, a data memory 20 and a controller 19; the controller 19 may be an MCU chip and has a built-in data processing program; the pressure transducer 12 and the temperature transducer 15 monitor temperature and pressure in the area with cracks 101 in the petroleum exploration channel 100 in real time, and transmit monitored temperature signal and pressure signal to the controller 19; and the controller 19 converts the temperature signal and the pressure signal into temperature data and pressure data respectively, and transmits the temperature data and the pressure data to the data memory for storage and retention.

The data logger 1 further includes an infrared transmitting module 16 and an infrared receiving module 17, and the infrared transmitting module 16 and the infrared receiving module 17 are respectively connected with and controlled by the controller 19. Here, the infrared transmitting module 16 wirelessly transmits the data stored in the data memory to an upper computer, and the infrared receiving module 17 receives control instructions and configuration information for controlling operation of the data logger 1, thus realizing wireless data communication.

The data logger 1 further includes a rechargeable battery 13, and the rechargeable battery 13 is connected with the controller 19; and the data logger 1 further includes a wireless charging coil 14, and the wireless charging coil 14 is connected with the rechargeable battery 13, and such structural arrangement enables the data logger 1 to be retrieved for charging and reuse, thus realizing the purpose of reuse, so that the battery can be fully charged and prepared for next exploration.

The data logger 1 further includes the housing 10; the pressure transducer 12, the temperature transducer 15, the data memory, a controller 19, the infrared transmitting module 16, the infrared receiving module 17, the rechargeable battery 13 and the wireless charging coil 14 are all integrated on a circuit board 11 to form a data acquisition module, and the data acquisition module is placed in a closed space of the housing 10; and the housing 10 is made of an insoluble material, and the housing 10 can be formed by splicing two half shells together, and the two half shells can be fixed by threaded connection or ultrasonic welding during splicing, thus forming a closed space for the data acquisition module to be placed on the housing 10.

The first shell 31 and the second shell 32 are made of a soluble material, so that the first shell 31 and the second shell 32 can effectively wrap the data logger in a solid state for a certain period of time, so that the data logger 1 is in a solid state and reaches a predetermined area with the bridge plug, and a fracturing fluid reacts with the first shell 31 and the second shell 32 to slowly dissolve, and the fracturing fluid applies pressure to the cracks during the dissolution process, so that the data logger 1 monitors temperature and pressure changes in the predetermined area, and after the first shell 31, the second shell 32, the bridge plug 200 and the soluble sleeve body 4 are all completely dissolved, the data logger 1 floats to a wellhead under the buoyancy of the fracturing fluid, which further facilitates retrieval of the data logger 1.

Embodiment 2

As shown in FIGS. 1 to 17, a data acquisition method applied to petroleum exploration engineering described in the present embodiment is a data acquisition method based on the data acquisition system of Embodiment 1, and the method is as follows.

At least one data logger 1 is mounted on a bridge plug 200 made of a soluble material. During mounting, the at least one data logger 1 is mounted in at least one dimple 202 on a soluble bridge plug body 201 of the bridge plug 200, an outer wall of a housing 10 of the at least one data logger 1 is closely fitted to an inner wall of the at least one dimple 202 on the soluble bridge plug body 201 of the bridge plug 200, or a mouth portion of the at least one dimple 202 on the soluble bridge plug body 201 of the bridge plug 200 is plugged with a soluble plug body to mount the data logger 1. Generally, the dimples 202 are provided at both ends of the soluble bridge plug body 201 of the bridge plug 200 to mount the data logger 1.

Alternatively, the at least one data logger 1 is placed in a mounting space of at least one soluble mounting body 3, and the at least one soluble mounting body 3 is connected with a connecting hole at an end portion of the soluble bridge plug body 201 of the bridge plug 200 by a connecting column 33 to mount the at least one data logger 1 on the soluble bridge plug body 201 of the bridge plug 200.

Alternatively, the at least one data logger 1 is mounted in a mounting hole 40 of a soluble sleeve body 4 and fixed to each other, and the soluble sleeve body 4 is sleeved and fixed to an end portion of the soluble bridge plug body 201 of the bridge plug 200 to mount the at least one data logger 1 on the soluble bridge plug body 201 of the bridge plug 200.

In the foregoing description, the number of data loggers 1 is generally eight, but the number of data loggers 1 may be selected to be more or less than eight according to the actual situation.

The bridge plug 200 with the at least one data logger 1 is placed into a petroleum exploration channel 100 and gradually displaced to a specified position.

The bridge plug 200 reaches the specified position, and the bridge plug 200 is expanded and snapped in the petroleum exploration channel 100, so that the at least one data logger 1 on the bridge plug 200 is located in an area with cracks 101 and a fracturing fluid in the petroleum exploration channel 100. Thus, it is possible to more accurately detect temperature and pressure environment in the area, allowing exploration workers to better judge oil seepage in the area after reading corresponding data.

The at least one data logger 1 on the bridge plug 200 enters an operating state to monitor temperature and pressure in the area with cracks 101 in the petroleum exploration channel 100 in real time by a pressure transducer 12 and a temperature transducer 15 of the data logger 1, and transmit monitored temperature signal and pressure signal to a controller 19 of the data logger 1. The controller 19 of the data logger 1 converts the temperature signal and the pressure signal into temperature data and pressure data respectively, and transmits the temperature data and pressure data to a data memory of the data logger 1 for storage and retention, thus facilitating subsequent retrieval and reading.

After the bridge plug 200 is dissolved in the fracturing fluid, the at least one data logger 1 floats to a mouth portion of the petroleum exploration channel 100 under the buoyancy of the fracturing fluid. Here, the data logger 1 has buoyancy in the fracturing fluid as the data logger has a hollow and fully enclosed housing 10.

The data logger 1 is retrieved, and then an upper computer is communicatively connected with the data logger 1 to read the data stored in the data memory of the data logger 1, and the upper computer analyzes the read data.

During gradual displacement of the soluble bridge plug body 201 in the petroleum exploration channel 100, the pressure transducer 12 and the temperature transducer 15 of the data logger 1 sense environmental conditions around the data logger 1 in real time to determine whether it has reached the specified position, and when the detected environmental data is within the controlled preset threshold range, it is determined that the soluble bridge plug body has reached the specified position.

A specific structure for mounting the soluble mounting body 3 on the soluble bridge plug body 201 via a connecting structure is the mounting structure in Embodiment 1.

In the present embodiment, the data logger 1 uses an infrared transmitting module 16 to wirelessly transmit the data stored in the data memory to the upper computer, and/or the data logger 1 uses an infrared receiving module 17 to receive control instructions and configuration information for controlling operation of the data logger 1, which performs data communication in a wireless manner, so that the pressure transducer 12, the temperature transducer 15, the data memory, the controller 19, the infrared transmitting module 16, the infrared receiving module 17, a rechargeable battery 13 and a wireless charging coil 14 are all placed in a closed space of the insoluble housing 10, and data transmission and reception can also be achieved.

In the present embodiment, after the data logger 1 is retrieved, the rechargeable battery 13 is charged by the wireless charging coil 14 to prepare for next use.

In the present embodiment, an operating state of an indicator light 18 of the data logger 1 allows a user to know corresponding device state, where the indicator light 18 is an LED indicator light 18.

When the indicator light 18 of the data logger 1 is in an on state, the data logger 1 is in the operating state.

When the indicator light 18 of the data logger 1 is in an off state, the data logger 1 is in a shutdown state.

When the indicator light 18 of the data logger 1 is in a flashing state, the data logger 1 is in an operating state of receiving or transmitting data.

In the foregoing description, the insoluble housing 10 may be light-transmissive, so that the on/off state of the indicator light 18 can be directly observed.

What is claimed is:

1. A data acquisition system applied to petroleum exploration engineering, comprising:

a bridge plug made of a soluble material and configured to be placed in a petroleum exploration channel; and at least one data logger mounted on the bridge plug, the at least one data logger being located in an area with cracks in the petroleum exploration channel after the bridge plug is expanded and set in the petroleum exploration channel;

wherein the at least one data loggers comprises a housing, and a pressure transducer, a temperature transducer, a data memory and a controller placed in a closed space of the housing; the pressure transducer and the temperature transducer are configured to monitor temperature and pressure in the area with cracks in the petroleum exploration channel in real time, and to transmit monitored temperature and pressure signals to the controller; and the controller is configured to convert the temperature and pressure signals into temperature and pressure data respectively, and to transmit the temperature and pressure data to the data memory for storage and retention; and the bridge plug comprises a soluble bridge plug body and a soluble sleeve body hooped on the soluble bridge plug body, and at least one mounting hole is provided on the soluble sleeve body;

and the housing of the at least one data logger is at least partially placed in the at least one mounting hole and is fixed to each other.

2. The data acquisition system applied to petroleum exploration engineering according to claim 1, wherein the soluble sleeve body comprises a first hoop body and a second hoop body, the first hoop body and the second hoop body are symmetrically arranged and fixed to each other, at least one of the first hoop body and the second hoop body is provided with the at least one mounting hole, and the first hoop body and the second hoop body are both made of a soluble material.

3. The data acquisition system applied to petroleum exploration engineering according to claim 2, wherein the soluble sleeve body further comprises an elastic connecting wire; the elastic connecting wire is located between an outer wall on the first hoop body and a mounting area on the first hoop body for mounting the data logger, or the elastic connecting wire is located between an outer wall on the second hoop body and a mounting area on the second hoop body for mounting the data logger; and one end of the elastic connecting wire is simultaneously connected with one end of the first hoop body and one end of the second hoop body, and the other end of the elastic connecting wire is simultaneously connected with the other end of the first hoop body and the other end of the second hoop body, so that an inner wall on a half groove of the first hoop body and an inner wall on a half groove of the second hoop body are tightly adhered to an outer wall of the soluble bridge plug body, so that the soluble sleeve body is sleeved and fixed to the outer wall of the soluble bridge plug body, and an outer side of the elastic connecting wire is abutted against an outer wall of the data logger.

4. The data acquisition system applied to petroleum exploration engineering according to claim 3, wherein a convex strip is provided on the first hoop body or the second hoop body, and the convex strip is arranged continuously or at intervals along an edge of the inner wall of the half groove of the first hoop body or the second hoop body, and the elastic connecting wire is located between an outer wall of the convex strip and the mounting area on the first hoop body or the second hoop body for mounting the data logger.

5. The data acquisition system applied to petroleum exploration engineering according to claim 1, wherein the at least one data logger further comprises an infrared transmitting module and an infrared receiving module, and the infrared transmitting module and the infrared receiving module are electrically connected with and controlled by the controller respectively.

6. The data acquisition system applied to petroleum exploration engineering according to claim 5, wherein the data logger further comprises a rechargeable battery and a wireless charging coil, the rechargeable battery is electrically connected with the controller, and the wireless charging coil is electrically connected with the rechargeable battery.

7. The data acquisition system applied to petroleum exploration engineering according to claim 6, wherein the pressure transducer, the temperature transducer, the data memory, the controller, the infrared transmitting module, the infrared receiving module, the rechargeable battery and the wireless charging coil are all placed in the closed space of the housing, and the housing is made of an insoluble material.

8. A data acquisition method applied to petroleum exploration engineering, comprising:

mounting at least one data logger on a bridge plug made of a soluble material;

placing the bridge plug into a petroleum exploration wellbore and gradually moving the bridge plug to a specified position;

after the bridge plug reaches the specified position, expanding and setting the bridge plug in the wellbore, so that the at least one data logger is located in an area with cracks and fracturing fluid in the wellbore;

placing the at least one data logger in an operating state;

monitoring temperature and pressure in the area with cracks in real time by a pressure transducer and a temperature transducer of the at least one data logger;

transmitting monitored temperature and pressure signals to a controller of the data logger; converting the temperature and pressure signals into temperature and pressure data respectively; transmitting the temperature and pressure data to a data memory of the at least one data logger for storage and retention;

dissolving the bridge plug in the fracturing fluid after the bridge plug is dissolved in the fracturing fluid, floating at least one data logger to a mouth portion of the wellbore under the buoyancy of the fracturing fluid;

retrieving the at least one data logger, and communicatively connecting a surface computer with the at least one data logger reading the data stored in the data memory of the at least one data logger, and analyzing the read data by the surface computer; and mounting the at least one data logger in a mounting hole of a soluble sleeve body and fixing the at least one data logger thereto, and sleeving and fixing the soluble sleeve body to an end portion of a soluble bridge plug body of the bridge plug to mount the at least one data logger on the soluble bridge plug body of the bridge plug.

9. The data acquisition method applied to petroleum exploration engineering according to claim 8, wherein the at least one data logger wirelessly transmits the data stored in the data memory of the at least one data logger to the surface computer using an infrared transmitting module, and/or the at least one data logger receives control instructions and configuration information for controlling operation of the at least one data logger using an infrared receiving module.

10. The data acquisition method applied to petroleum exploration engineering according to claim 8, wherein after the at least one data logger is retrieved, a rechargeable battery is charged by a wireless charging coil in preparation for next use.

11. The data acquisition method applied to petroleum exploration engineering according to claim 8, wherein an operating state of an indicator light of the at least one data logger enables a user to know corresponding device state;

when the indicator light of the at least one data logger is in an on state, the at least one data logger is in the operating state;

when the indicator light of the at least one data logger is in an off state, the at least one data logger is in a shutdown state; and when the indicator light of the at least one data logger is in a flashing state, the at least one data logger is in an operating state of receiving or transmitting data.

12. The data acquisition method applied to petroleum exploration engineering according to claim 8, wherein the at least one data logger has buoyancy in the fracturing fluid due to a hollow and fully enclosed housing.

* * * * *